US005901601A

United States Patent [19]

Fujimoto et al.

[11] Patent Number: 5,901,601

[45] Date of Patent: May 11, 1999

[54] METHOD AND APPARATUS FOR BENDING MALLEABLE PLATES

[75] Inventors: Nobuyuki Fujimoto, Toyota; Takeo Muro, Okazaki, both of Japan

[73] Assignee: Toyota Jidosha Kabushiki Kaisha, Japan

[21] Appl. No.: 09/056,889

[22] Filed: Apr. 8, 1998

[30] Foreign Application Priority Data

Apr. 25, 1997 [JP] Japan ..... 9-109617

[51] Int. Cl.[6] ..... B21D 5/01

[52] U.S. Cl. ..... 72/389.1; 72/382; 72/347; 72/389.6

[58] Field of Search ..... 72/389.1, 389.2, 72/389.6, 311, 382, 386, 347, 350

[56] References Cited

U.S. PATENT DOCUMENTS

| | | | |
|---|---|---|---|
| 4,373,371 | 2/1983 | Liu | 72/382 |
| 4,416,142 | 11/1983 | Thorne-Thomsen | 72/353.4 |
| 5,501,094 | 3/1996 | Mizuta et al. | 72/389.2 |

FOREIGN PATENT DOCUMENTS

| | | | |
|---|---|---|---|
| 216868 | 8/1961 | Austria | 72/347 |
| 53-113257 | 10/1978 | Japan | 72/389.6 |
| 53-38708 | 10/1978 | Japan | 72/389.6 |
| 58-96812 | 7/1983 | Japan . | |
| 59-42140 | 1/1984 | Japan | 72/347 |
| 60-3923 | 1/1985 | Japan | 72/347 |
| 63-97313 | 4/1988 | Japan | 72/389.1 |
| 2-247019 | 10/1990 | Japan . | |
| 3-264116 | 11/1991 | Japan . | |
| 3-294019 | 12/1991 | Japan . | |
| 4-172128 | 6/1992 | Japan | 72/382 |
| 4-231113 | 8/1992 | Japan | 72/382 |
| 1433603 | 10/1988 | U.S.S.R. | 29/894.354 |

*Primary Examiner*—David Jones
*Attorney, Agent, or Firm*—Finnegan, Henderson, Farabow, Garrett & Dunner, L.L.P.

[57] ABSTRACT

In a method and apparatus for press bending a metal plate, a punch is inserted into a recess of a die to bend a plate. The punch has a first edge formed away from a die and a second edge formed near the die. A corner of the recess of the die opposed to the punch is chamfered. The chamfered face has a third edge formed at the border of the top side of the die at the chamfered recess. In a first half of the press bending, the plate is bent with the first and third edges serving as lines of contact. Subsequently, the plate is further bent with the second edge serving as a line of contact. A portion of the punch between the first and second edges is held in a non-contact state with the plate throughout steps of press bending the plate.

14 Claims, 8 Drawing Sheets

METHOD AND APPARATUS FOR BENDING MALLEABLE PLATES

BACKGROUND OF THE INVENTION

1. Field of the Invention

This invention relates to improved techniques for press bending a malleable plate, such as a metal plate, by inserting a punch into a recess of a die. More particularly, the present invention relates to such press bending techniques for deforming the malleable plate into a shape conforming to a distal end face and a side face of the punch, thereby bending the plate into a desired shape.

2. Description of the Related Art

Japanese Laid-Open Patent Publication No. 3-264116 discloses a related conventional method of press bending a metal plate. This conventional method will be described with reference to FIGS. 7 and 8. Press 1 has been adapted for bending both ends of a steel plate W approximately at right angles to a central portion of the steel plate W, and thereby form a product generally having a U-shape in cross section. Such a press has been previously used to manufacture bumpers for automobiles.

The press 1 includes a die 4 fixed at a predetermined position and a vertically movable punch 2. FIG. 7 illustrates an example in which the bending operation of the steel plate W by the punch 2 and die 4 has been completed.

The punch 2 is formed into a thick plate-like shape and has, between bottom and side faces thereof, two corners or rounded edges that serve to bend the plate W. Each corner is chamfered into a rounded face 2*r*. The punch 2 has a distal end, namely, a bottom or terminated end formed with a shallow groove 2*m* for the plate W to permit metal to be transferred from the central portion of the plate to the bent corners during the bending process.

The die 4 has a recess 4*m* into which the punch 2 is inserted. Each opening edge between a top face 4*u* and a side face 4*s* of the recess 4*m* also is chamfered to a rounded face 4*f*. Each corner between the side face 4*s* and a bottom face 4*b* of the recess 4*m* also is chamfered to a rounded face 4*r* which forms the bent portion Wt of the metal plate W (see FIG. 8(C)) in co-operation with the punch 2. The clearance between the punch 2 and the recess 4*m* of the die 4 is set to be as small as possible to enhance bending accuracy.

In the press bending operation, the flat plate W is set on the top face 4*u* of the die 4, and the punch 2 is then moved downward. The punch 2 is inserted into the recess 4*m* of the die 4 (see FIG. 8(A)). In the process of the punch 2 moving to reach its lowest position (see FIG. 8(B)), the plate W is deformed into a shape conforming to the distal end face and side faces of the punch 2, so that both ends of the plate W are bent approximately at right angles to its central portion.

According to the above-described method, the clearance between the punch 2 and the recess 4*m* of the die 4 is set to be as small as possible, and the opening edge of the recess 4*m* is formed as the rounded face 4*f*. Accordingly, both ends of the plate W are brought into face-to-face contact with the rounded face 4*f* of the die 4 when the punch 2 is inserted into the recess 4*m* of the die 4 to bend the plate W (see FIG. 8(A)). Subsequent to the face-to-face contact with the rounded face 4*f*, the ends of the plate W are pressed into the clearance between the punch 2 and the recess 4*m* (see FIG. 8(B)). In other words, both ends of the plate W are rubbed against the rounded face 4*f* and thereafter pressed into the clearance. Therefore, each end of the plate W is pressed by the punch 2 and the die 4 with an unrelieved stress remaining in each end. The remaining stress tends to deform each bent edge to conform to the rounded face 4*f* of the die 4. This unrelieved stress results in local warping Ws or swelling Wh as shown in FIG. 8(D), when the product W is taken out of the press 1 after being bent.

Furthermore, the bent portion Wt of the plate W is closely pressed between the rounded face 2*r* of the punch 2 and the rounded face 4*r* of the recess 4*m*. Accordingly, a stress resulting from the difference in the length between the inside corner and the outside corner of the bent portion Wt of the plate W remains in the bent portion Wt. The remaining stress tends to stretch the inside corner of the bent portion Wt, resulting at the bent portion Wt as shown in FIG. 8(C). Thus, the above-described conventional press bending method does not accurately reproduce the desired shape for the bent products.

SUMMARY OF THE INVENTION

Therefore, one object of the present invention is to provide a method of press bending in which swelling can be significantly reduced or prevented in the bent portions of the bent product.

Another object of the invention is to provide a method of press bending in which local warping can be significantly reduced or prevented in the ends of the bent product.

A third object of the invention is to provide a press which can bend malleable material into desired shapes with high accuracy.

In one aspect, the present invention provides a method of press bending in which a punch is inserted into a recess of a die to thereby bend a malleable plate into a shape conforming to the distal end face and side face of the punch. A preferred method of this type comprises the steps of bending the plate with a first edge provided at an outer side of the distal end face of the punch, which first edge serves as a line of contact with the plate, and further bending the plate with a second edge provided at a lower side of the side face of the punch, which second edge serves as a line of contact with the plate after the plate bent during the previous step comes into contact with the second edge. In this method, a portion of the punch between the first and second edges does not contact the plate throughout these steps.

By using the above-described method, unrelieved stress in the bent portion of the plate at the time of completion of the bending operation is substantially reduced and accordingly, the plate can be bent with high accuracy to the desired shape.

In another aspect of the invention, an apparatus for pressing a plate to thereby bend the plate is provided. The apparatus comprises a die having a recess and a punch to be inserted into the recess of the die. In a preferred apparatus, the punch has an end which is inserted into the recess of the die, and the end of the punch is formed with a distal end face, an inclined face, and a side face. The end of the punch also is formed with a first edge between the distal end face and the inclined face and a second edge between the inclined face and the side face. In addition, an opening edge of the recess of the die is chamfered, and a third edge is formed at the border of the chamfered recess and a top face of the die. Finally, the inclined face has a larger radius of curvature than a curvature of the bent portion of the plate being bent with the first and third edges serving as lines of contact with the plate.

By using the preferred apparatus, unrelieved stress in the bent portion and the end portion of the bent plate is substantially reduced and accordingly, the plate can be bent with high accuracy.

In the above-described apparatus, a plane between the first and third edges when the plate starts to contact the second edge is preferably approximately parallel to the chamfered face of the die.

Furthermore, first contact of the plate with the second edge is preferably substantially in synchronism with first contact of the plate with a fourth edge formed between a side face and the chamfered face of the recess of the die.

Further objects and aspects of the invention will be understood more fully upon reviewing the following description of the preferred embodiments with reference to the drawings and the appended claims.

DETAILED DESCRIPTION OF THE PREFERRED EMBODIMENTS

Figure 1:
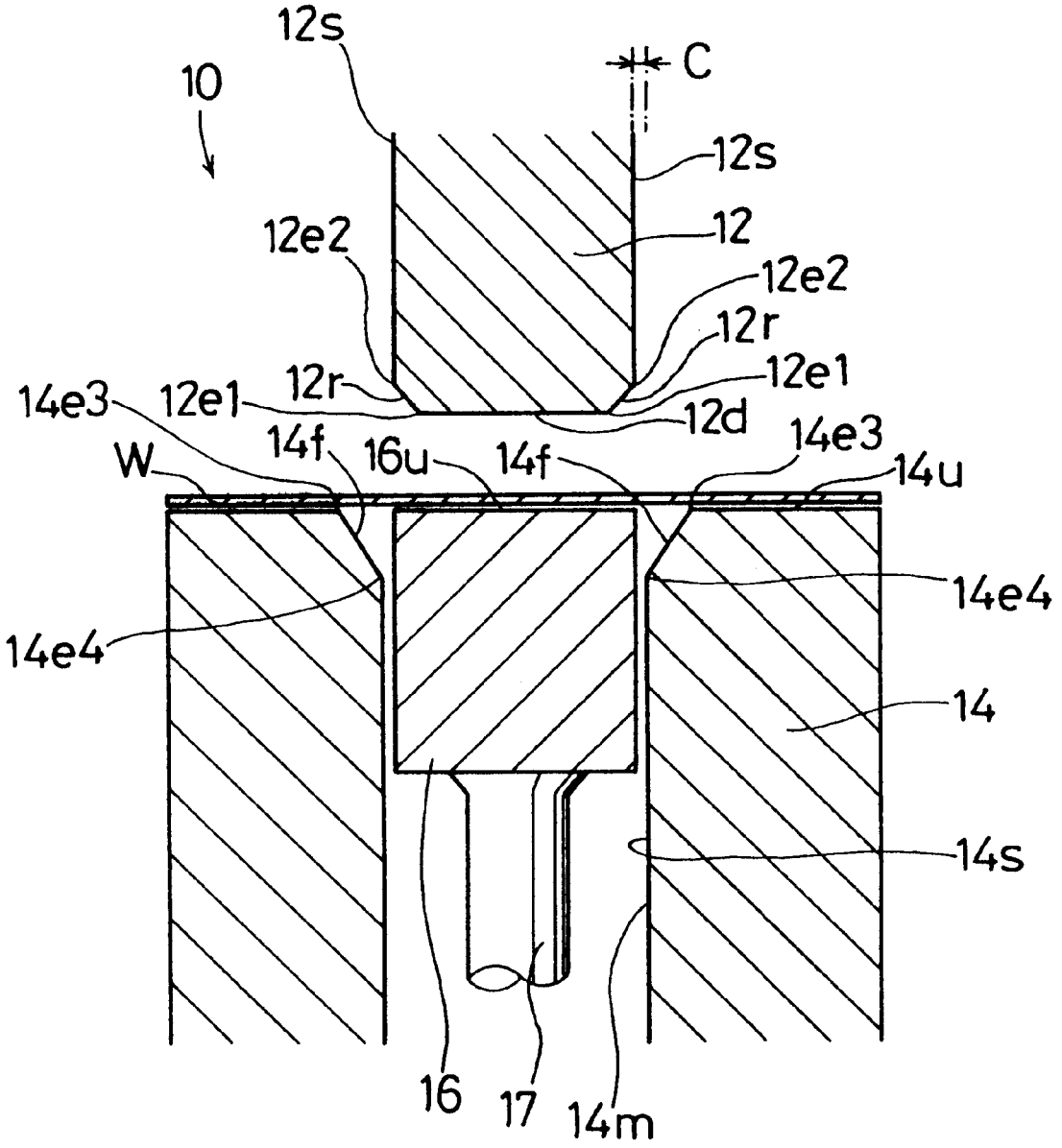
FIG. 1 is a partial longitudinal section of a press bending apparatus of one preferred embodiment in accordance with the present invention.
Figure 2:
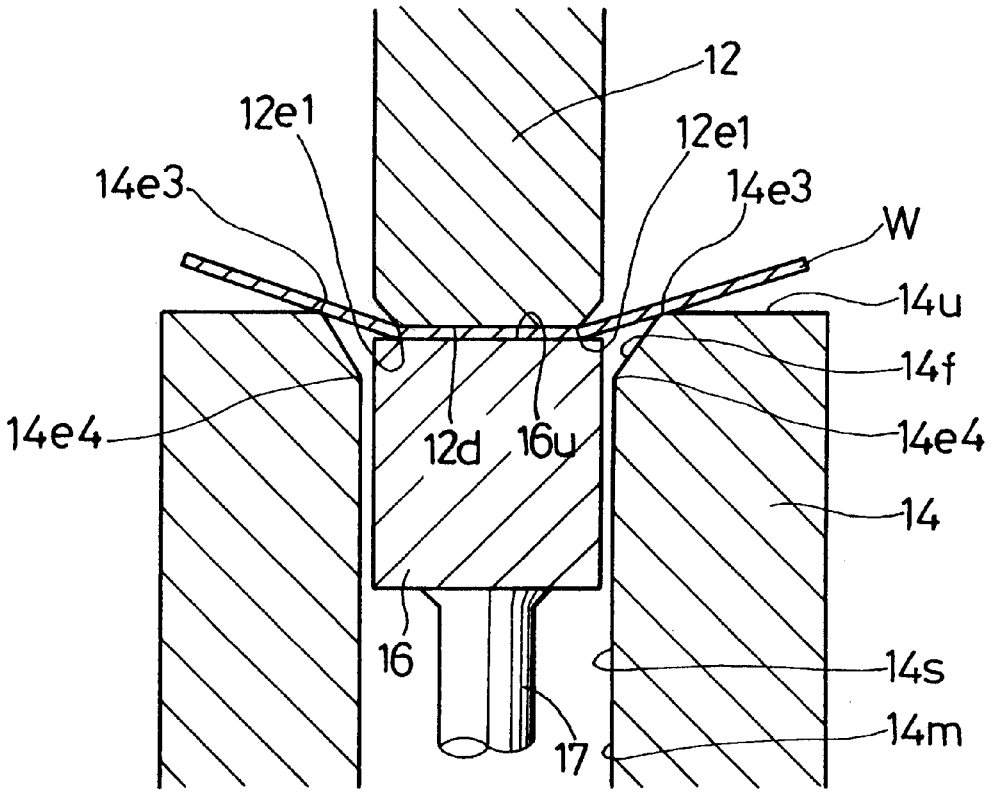
FIGS. 2(A) and 2(B) are partial longitudinal sections of the apparatus showing a first stage of the preferred press bending method.
Figure 2:
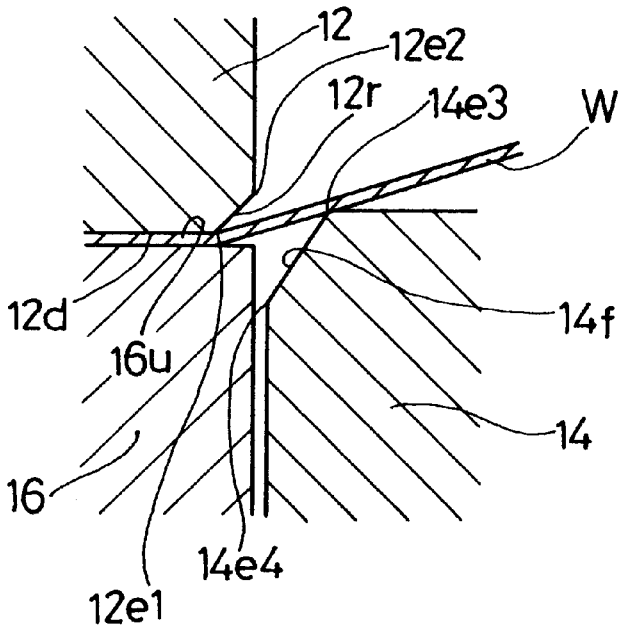

Preferred embodiments of the present invention will be described with reference to FIGS. 1 to 6. Referring to FIG. 1, a preferred press bending apparatus 10 of the present invention is shown. The press 10 is adapted for bending opposite ends of a plate W approximately at right angles to a central portion of the plate thereby forming a product having a generally U-shape in cross section. The press 10 comprises a vertically movable punch 12 and a die 14 fixed at a predetermined position. The plate can be any malleable material, although preferably the preferred apparatus and method are utilized to bend metal plates. Also, while FIGS. 1 to 6 show a preferred embodiment for making two right angle bends in the plate W, a punch and die according to the present invention may be constructed to make a single right angle bend in the plate. Further the bend angle need not be 90 degrees for practicing the present invention.

The punch 12 of FIG. 1 is constructed having a thick plate-like shape according to a desired shape of the product to be formed by the press 10. The punch 12 includes a flat bottom side or distal end face 12*d* and two corners at which the plate W is bent. Each corner is chamfered into an inclined face 12*r*. The punch 12 has a first edge 12*e*1 between each inclined face 12*r* and the distal end face 12*d*, and a second edge 12*e*2 between each inclined face 12*r* and each side face 12*s* thereof. An upper portion (not shown) of the punch 12 is connected to the press 10, for example, via a punch holder (not shown) or a ram (not shown), so that the punch 12 is moved upward and downward upon upward and downward movement of the punch holder or the ram.

The die 14 includes a flat top face 14*u* and a recess 14*m* into which the punch 12 is inserted, as will be described in greater detail below. Each opening edge of the recess 14*m* is chamfered into an inclined face (chamfered face) 14*f*. The die 14 has a third edge 14*e*3 formed at the border of the inclined face 14*f* and the top face 14*u*. The die 14 further includes a fourth edge 14*e*4 between a side face 14*s* of the recess 14*m* and the inclined face 14*f*.

A clearance C defined between the side face 14*s* of the recess 14*m* of the die 14 and the side face 12*s* of the punch 12 is set to be approximately equal to the thickness of the plate W. The recess 14*m* of the die 14 accommodates therein a cushion pad 16 for supporting the plate W. A cushion rod 17 applies a predetermined upward force to the cushion pad 16 during the press bending operation.

A preferred method of press bending will now be described with reference to FIGS. 1 to 6. First, the punch 12 is held at an upper limit position and the plate W is set on the top face 14*u* of the die 14. The plate W is held horizontally since the upper face 16*u* of the cushion pad 16 is positioned to be coplanar with the top face 14*u* of the die 14, as shown in FIG. 1. In this state, the punch 12 is moved downward by the operation of the ram or the punch holder. In the process of downward movement, the distal end face 12*d* of the punch 12 abuts the upper surface of the plate W, so that the central portion of the plate W is held by the punch 12 and the cushion pad 16 on opposite sides of the plate W. The punch 12 is then forced to move downward so that the cushion pad 16 is also moved downward, against the upward force exerted thereon by the cushion rod 17, together with the punch 12.

Figure 3:
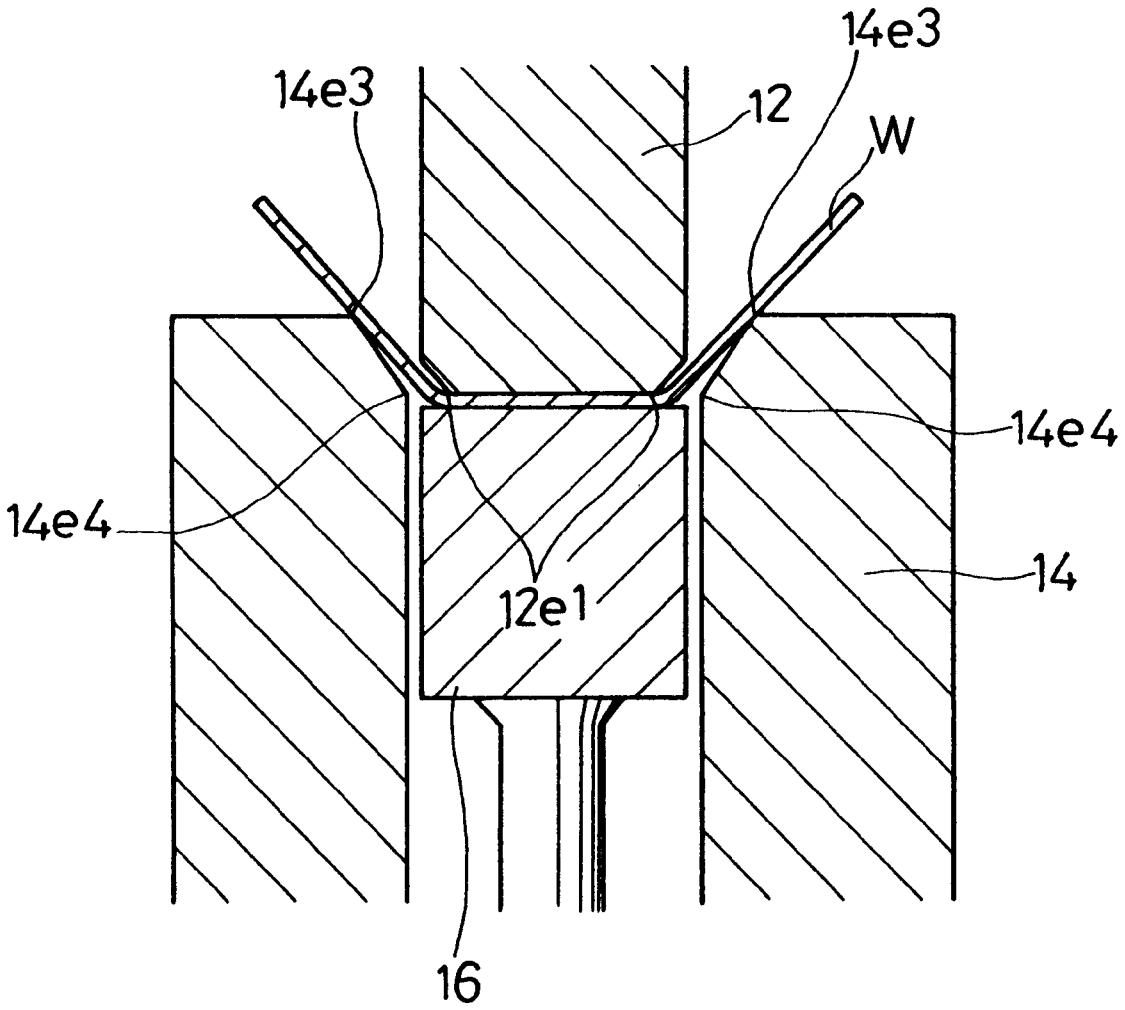
FIG. 3 is a partial longitudinal section of the apparatus showing a second stage of the preferred method.
Figure 4:
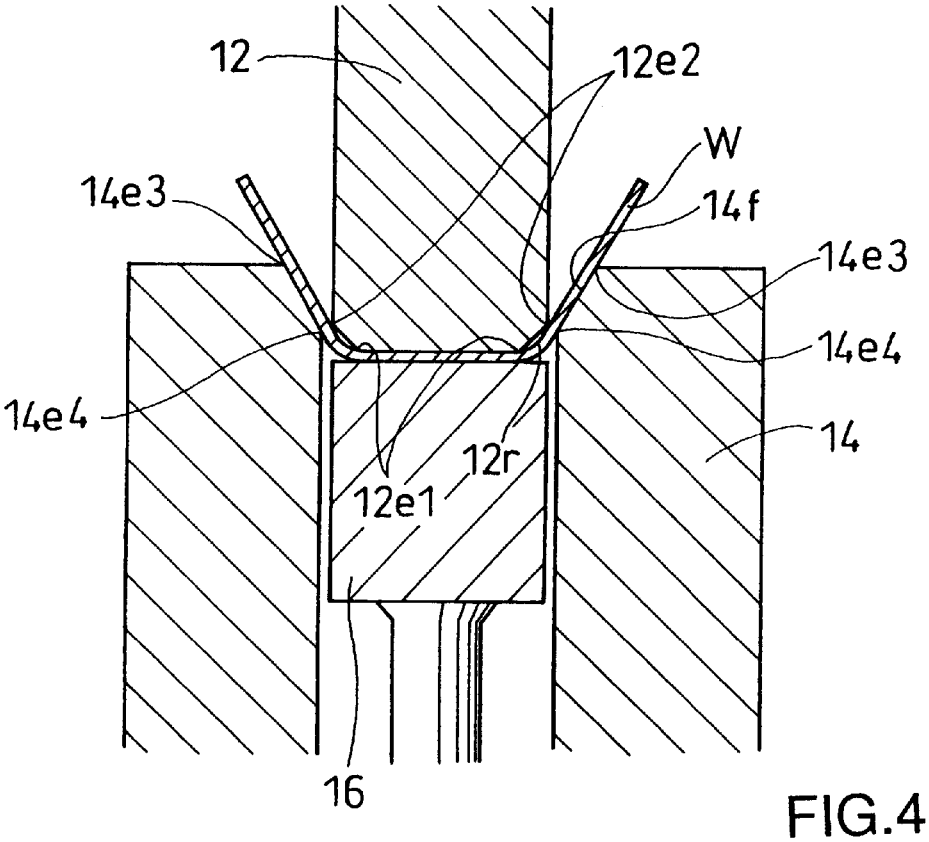
FIGS. 4(A) and 4(B) are partial longitudinal sections of the apparatus showing a third stage of the preferred method.
Figure 4:
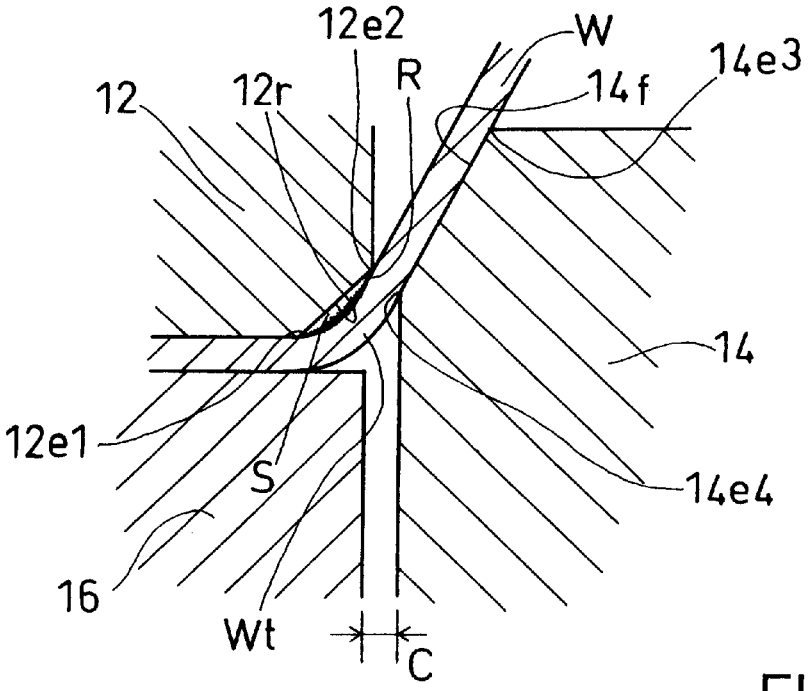

The central portion of the plate W is in contact with the first edges 12*e*1 of the punch 12, as shown in FIGS. 2(A) and 2(B), when the central portion of the plate W is moved downward being held by the punch 12 and the cushion pad 16. The opposite ends of the plate W contact the third edges 14*e*3 of the die 14. In other words, the plate W is bent with the first and third edges 12*e*1 and 14*e*3 serving as lines of contact as shown in FIG. 2(B). In this state, the plate W is continuously bent with the first and third edges 12*e*1 and 14*e*3 serving as the lines of contact as shown in FIG. 3, when the punch 12 is further moved downward.

The plate W comes into contact with the second edge 12*e*2 as shown in FIGS. 4(A) and 4(B) as the bending operation further progresses. The plate W then comes into direct contact with the inclined face 14*f* of the die 14 substantially in synchronism with the first contact of the plate W with the second edge 12*e*2. In other words, the first contact of the plate W with the second edge 12*e*2 is substantially in synchronism with the first contact of the plate W with the fourth edge 14*e*4. The reason for this is that a plane between the first and third edges 12*e*1 and 14*e*3 at the time of start of contact of the plate W with the second edge 12*e*2 is set to be substantially parallel to the chamfered or inclined face 14*f* of the die 14.

Since the plate W is flexed at each bent portion Wt with a curvature, a space S results between each bent portion Wt of the plate W and each inclined face 12*r* of the punch 12, so that the punch 12 and the plate W are held in a non-contact relation between the first and second edges 12*e*1 and 12*e*2 as shown in FIG. 4(B). That is, the inclined face 12*r* has a larger radius of curvature than the bent portion Wt of the plate W when the plate W is bent with the first and third edges 12*e*1 and 14*e*3 serving as the lines of contact. In this preferred embodiment, the inclined face 12*r* is flat and therefore the radius of curvature is infinite. However, the inclined face 12*r* may also be constructed to have a finite radius of curvature that is greater than the radius of curvature of the bent portion of the plate W.

Figure 5:
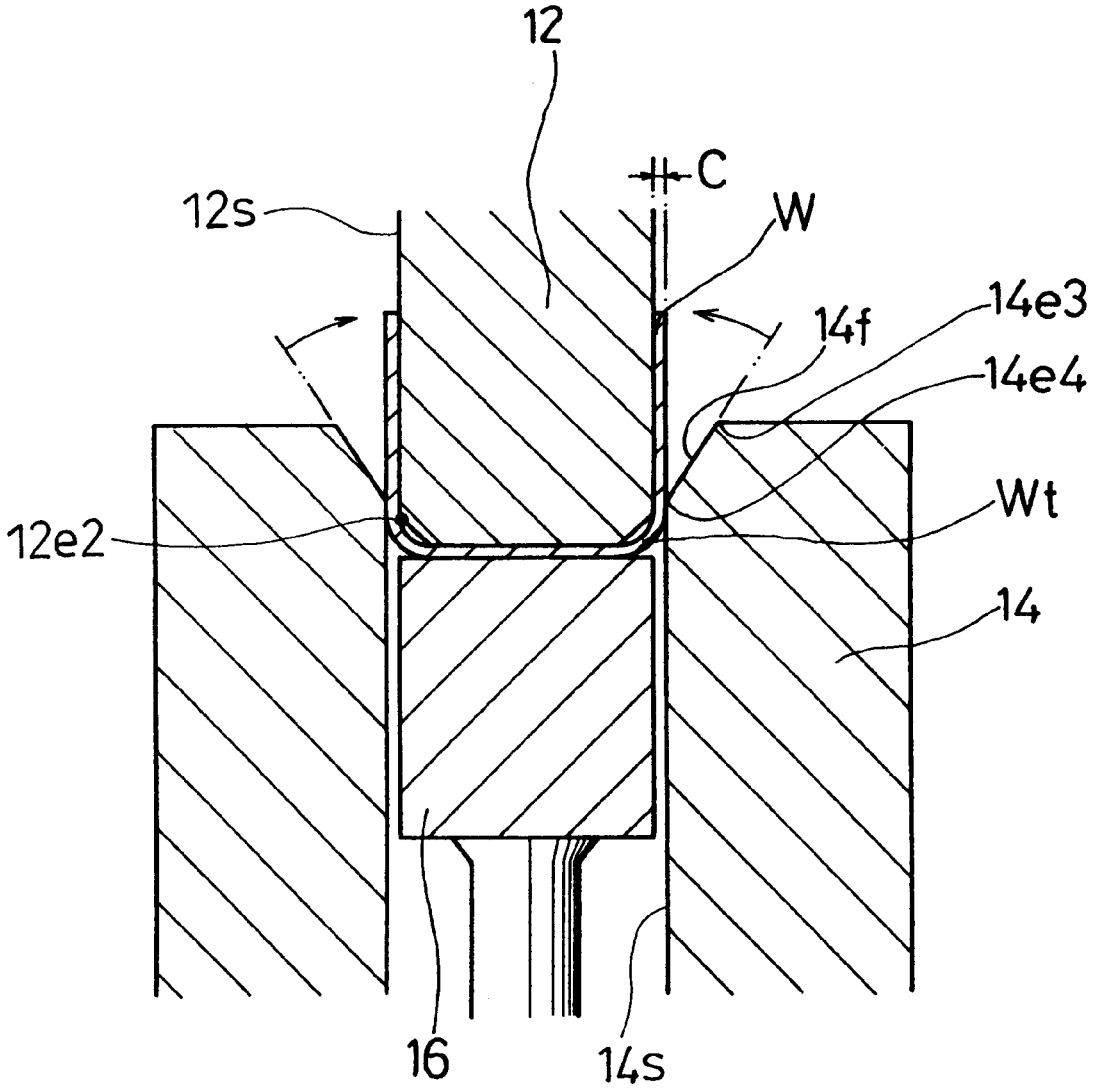
FIG. 5 is a partial longitudinal section of the apparatus showing a fourth stage of the preferred method.
Figure 6:
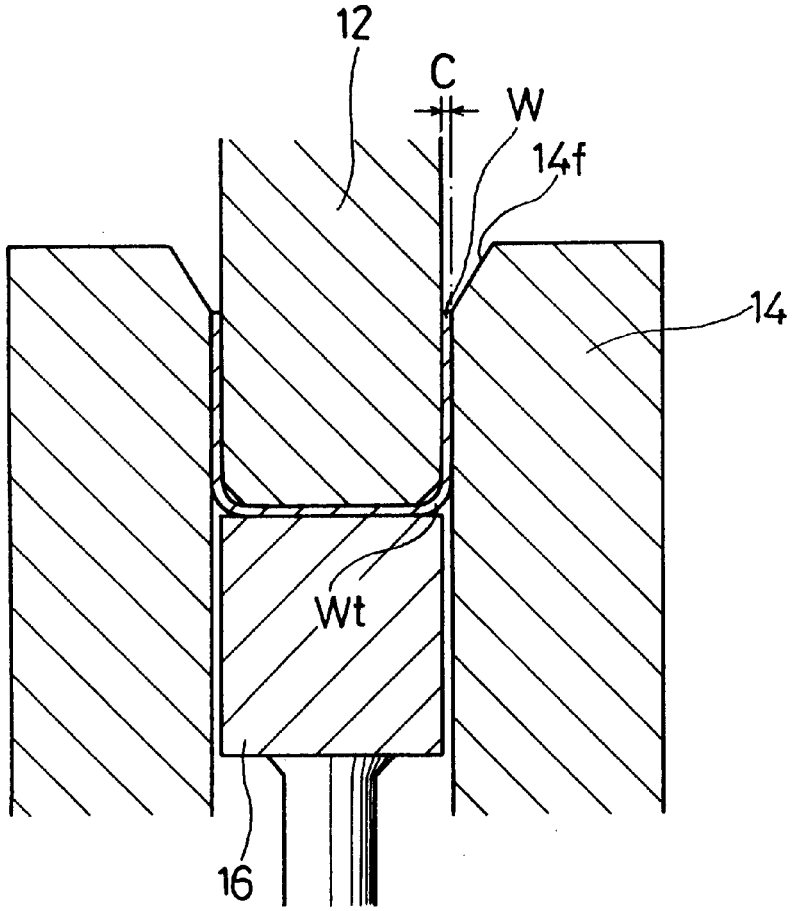
FIGS. 6(A) and 6(B) are longitudinal sections of the apparatus showing a fifth stage of the preferred method.
Figure 6:
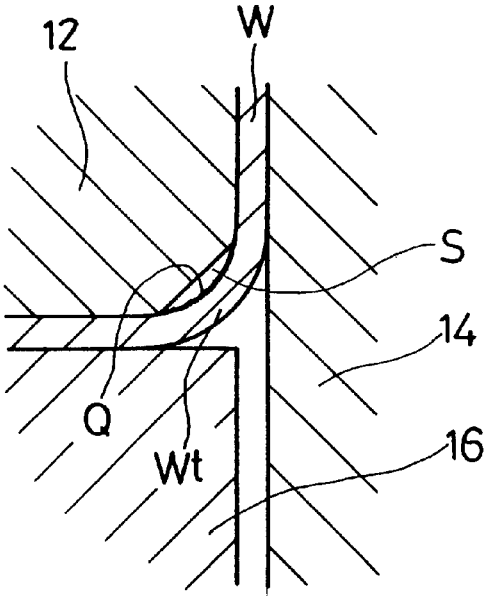
Figure 7:
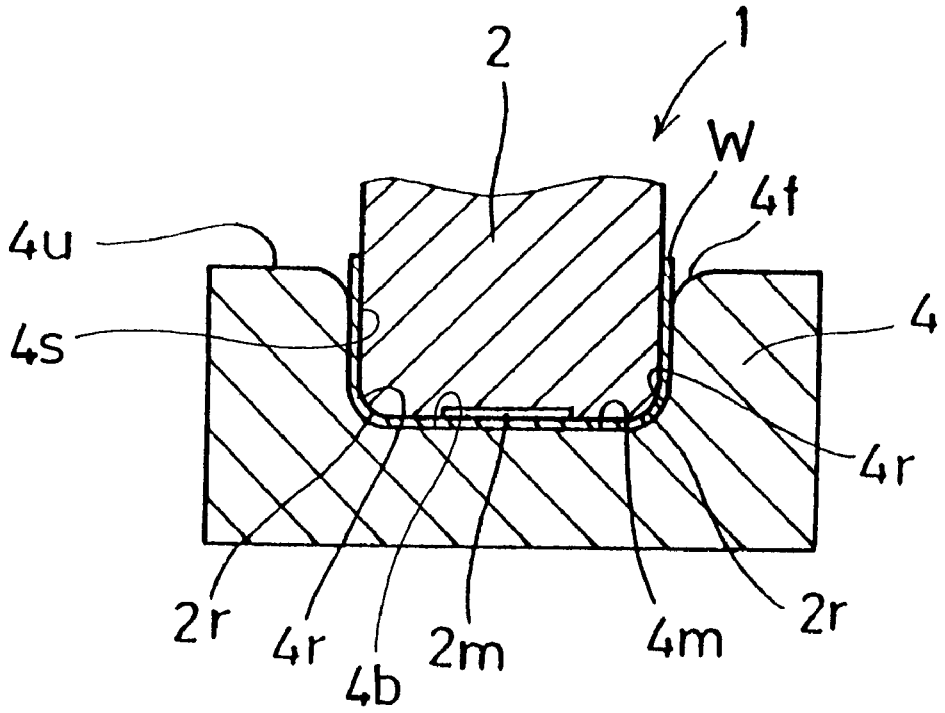
FIG.7 PRIOR ART
FIG. 7 is a partial longitudinal section of a conventional press bending apparatus.
Figure 8:
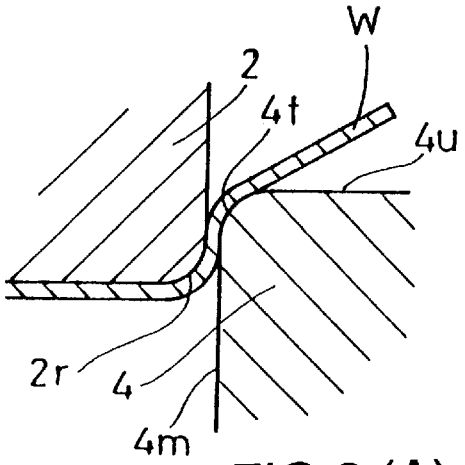
FIG.8 (A) PRIOR ART
FIGS. 8(A) and 8(B) are partial longitudinal sections of the conventional press bending apparatus showing two steps of the conventional press bending method.
FIGS. 8(C) and 8(D) are partial longitudinal sections of the bent plate after completion of the press bending operation.
Figure 8:
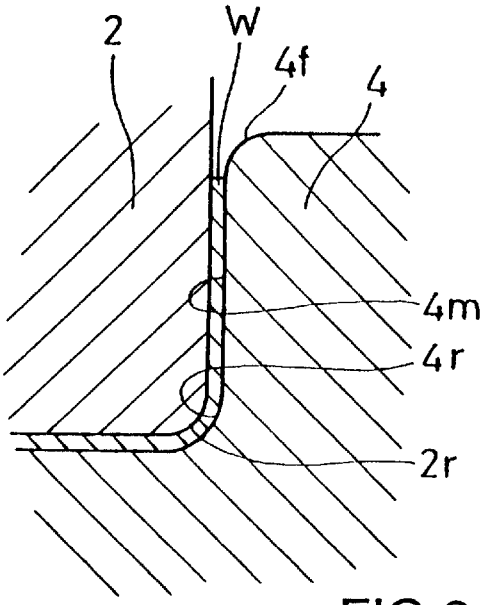
FIG.8 (B) PRIOR ART
Figure 8:
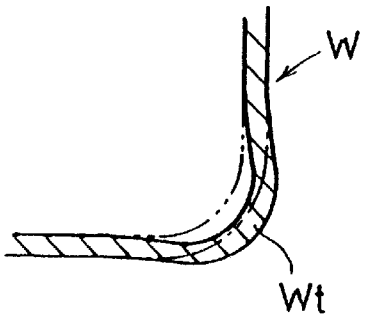
FIG.8 (C) PRIOR ART
Figure 8:
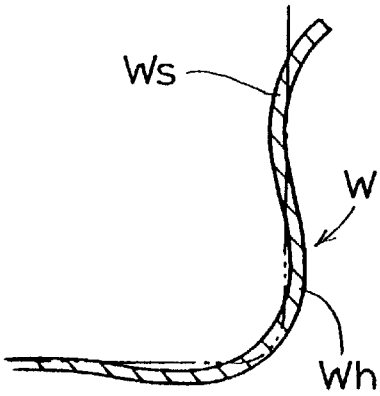
FIG.8 (D) PRIOR ART

As shown in FIG. 5, the opposite ends of the plate W are held between a portion of the side face 12*s* of the punch 12 over the second edge 12*e*2 and a portion of the side face 14*s* of the die 14 below the fourth edge 14*e*4 when the punch 12 is further moved downward. Consequently, the ends of the plate W are bent to assume positions in which the ends are substantially parallel to the side faces 12*s* of the punch 12, as shown in FIG. 5. In other words, the opposite ends of the plate W are folded into the clearance C between the punch 12 and the die 14 and are thereby bent approximately at right angles to the central portion of the plate W.

In the process of further downward movement of the punch 12 to the bottom limit, the opposite ends of the plate W are pressed into the clearance C between the punch 12 and the die 14. Thus, the entire plate W is held between the punch 12 and the die 14 as shown in FIG. 6(A). In this state, the bending operation of the plate W is completed.

According to the above-described method of and apparatus for the press bending operation, the plate W can be bent with the space S being provided at the inside of each bent portion Wt of the plate W. More specifically, between the first and second edges 12*e*1 and 12*e*2, the space S prevents the punch 12 from contacting each bent portion Wt of the plate W. This results in an excess of material, shown as thickness Q in FIG. 6(B), remaining in the inside of each bent portion Wt. Accordingly, stress due to the difference in length between the inside and the outside of each bent portion Wt of the plate W can be reduced. Therefore, problems in prior art press bending techniques, such as swelling and warping due to unrelieved stress in the bent portions Wt of the product W after the product is taken out of the press 10, can be prevented.

Furthermore, the opposite ends of the plate W are kept in line contact with the third edges 14*e*3 until the opposite ends of the plate W are folded to approximately right angles to the central portion of the plate. Both the ends of the plate W contact the side faces 12*s* and 14*s* only after the ends of the plate W have been bent at right angles to the central portion of the plate W. Accordingly, because the ends of the plate W do not rub against the opening edge of the recess 14*m* of the die 14 while the ends are being inserted between the side faces 12*s* and 14*s*, unrelieved stress can be prevented at the ends of the plate w. Consequently, warping and swelling also can be prevented at the ends of the plate W after the product is taken out of the press 10.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

We claim:

1. A method of press bending a plate of malleable material in which a punch is inserted into a chamfered recess of a die to thereby bend the plate into a shape conforming to a distal end face and a side face of the punch, the method comprising the steps of:

a first bending step comprising bending the plate with a first edge provided at an outer side of the distal end face of the punch and a third edge provided at a border of the chamfered recess and a top surface of the die, said first and third edges serving as lines of contact with the plate; and a second bending step comprising bending the plate with a second edge provided at a lower side of the side face of the punch and the recess of the die, said second edge serving as a line of contact with the plate after the plate bent during the first bending step comes into contact with the second edge;

wherein a portion of the punch between the first and second edges does not contact the plate throughout the steps.

2. An apparatus for press bending a malleable plate into a desired shape, comprising:

a die having a recess; and a punch to be inserted into the recess of the die;

wherein the punch has an end which is inserted into the recess of the die, the end of the punch being formed with a distal end face, an inclined face, and a side face, the end of the punch being further formed with a first edge between the distal end face and the inclined face and a second edge between the inclined face and the side face;

wherein an opening edge of the recess of the die is chamfered, thereby forming a chamfered recess, and a third edge is formed at the border of the chamfered recess and a top surface of the die; and wherein the inclined face of the punch has a larger radius of curvature than a radius of curvature of the bent portion of the plate being bent with the first and third edges serving as lines of contact with the plate.

3. An apparatus according to claim 2, wherein the inclined face of the punch is flat.

4. An apparatus according to claim 2, wherein a plane between the first and third edges when the plate first contacts the second edge is approximately parallel to the chamfered face of the die.

5. An apparatus according to claim 2, wherein first contact of the plate with the second edge is substantially in synchronism with first contact of the plate with a fourth edge formed between a side face and the chamfered face of the recess of the die.

6. An apparatus for forming a bendable plate into a desired shape, comprising:

punch means having a first face for contacting the bendable plate, a second face for contacting the bendable plate and a third face connecting the first and second faces of the punch means and having a radius of curvature greater than a radius of curvature of a corresponding bent portion of the desired shape;

die means having a recess for accepting the punch means and having a first face substantially parallel to the first face of the punch means, the first face contacting the bendable plate before the bendable plate is bent, a second face substantially parallel to the second face of the punch means and a third face connecting the first and second faces of the die means;

the die means further including within the recess a cushion pad having a first face substantially parallel to the first face of the punch means;

wherein when the punch means is inserted into the die means, the second face of the punch means and the second face of the die means are separated by substantially the width of the bendable plate;

a first edge formed by the connection of the first face of the punch means and the third face of the punch means and a second edge formed by the connection of the first face of the die means and the third face of the die means, the bendable plate being bent by the cooperation of the first and second edges while the punch means is inserted into the recess of the die means.

7. An apparatus as in claim 6 wherein the radius of curvature of the third face of the punch means is chosen such that the third face of the punch means does not contact the bendable plate as the punch means is being inserted into the recess of the die means.

8. An apparatus as in claim 7 wherein the second face of the die means has sufficient length such that an end of the bendable plate contacts the second face of the punch means and the second face of the die means when the bendable plate is bent into the desired shape.

9. An apparatus as in claim 8 wherein the punch means further comprises:

a fourth face substantially parallel to the second face of the punch means for contacting the bendable plate and a fifth face connecting the first and fourth faces of the punch means and having a radius of curvature greater that a radius of curvature of a second corresponding bent portion of the desired shape; and the die means further comprises:

a fourth face substantially parallel to the first face of the die means, the fourth face contacting the bendable plate before the bendable plate is bent; a fifth face substantially parallel to the fourth face of the punch means and a sixth face connecting the fourth and fifth faces of the die means.

10. An apparatus as in claim 9 wherein a third edge is formed by the connection of the first face of the punch means and the fifth face of the punch means and a fourth edge is formed by the connection of the fourth face of the die means and the sixth face of the die means, wherein the bendable plate is bent by the cooperation of the third and fourth edges as the punch means is inserted into the recess of the die means.

11. An apparatus as in claim 10 wherein the radius of curvature of the fifth face of the punch means is chosen such that the fifth face of the punch means does not contact the bendable plate while the punch means is being inserted into the recess of the die means.

12. An apparatus as in claim 11 wherein the fifth face of the die means has sufficient length such that an end of the bendable plate contacts the fourth face of the punch means and the fifth face of the die means when the bendable plate is bent into the desired shape.

13. An apparatus as in claim 12 further comprising a cushion rod connected to the cushion pad, the cushion rod providing a counter force when the punch means is inserted into the die means.

14. A method of press bending a plate of malleable material in which a punch is inserted into a recess of a die to thereby bend the plate into a shape conforming to a distal end face and a side face of the punch, the method comprising the steps of:

providing an outer side of the distal end of the punch with an inclined face devoid of a stepped cross-section;

bending the plate with a first edge provided at a first end of the inclined face, said first edge serving as a line of contact with the plate;

bending the plate with a second edge provided at a second end of the inclined face, said second edge serving as a line of contact with the plate after the plate bent during the first bending step comes into contact with the second edge; and maintaining a portion of the inclined face between the first and second edges out of contact with the plate throughout the press bending.

* * * * *